US008540455B1

(12) United States Patent
Maddux

(10) Patent No.: US 8,540,455 B1
(45) Date of Patent: Sep. 24, 2013

(54) HEATED PAVEMENT SEALANT SYSTEM

(76) Inventor: Donald P. Maddux, River Falls, WI (US)

( * ) Notice: Subject to any disclaimer, the term of this patent is extended or adjusted under 35 U.S.C. 154(b) by 0 days.

(21) Appl. No.: 13/541,393

(22) Filed: Jul. 3, 2012

(51) Int. Cl.
*E01C 11/24* (2006.01)

(52) U.S. Cl.
USPC ..... 404/71; 404/77

(58) Field of Classification Search
CPC ..... E01C 9/00
USPC ..... 404/17, 21, 71, 77, 79
See application file for complete search history.

(56) References Cited

U.S. PATENT DOCUMENTS 3,999,040 A * 12/1976 Ellis ..... 219/543
4,594,022 A * 6/1986 Jeppson ..... 404/28
6,825,444 B1 * 11/2004 Tuan et al. ..... 219/213
2002/0001506 A1 * 1/2002 Wilson, Sr. ..... 404/75
2003/0121906 A1 * 7/2003 Abbott et al. ..... 219/543
2005/0047864 A1 * 3/2005 Yamada et al. ..... 404/71
2011/0089160 A1 * 4/2011 Kuriki ..... 219/553
2012/0321383 A1 * 12/2012 Sieger ..... 404/71

* cited by examiner

*Primary Examiner* — Raymond W Addie
(74) *Attorney, Agent, or Firm* — Tipton L. Randall

(57) ABSTRACT

A fluid pavement sealer composition includes a liquid phase having a sealant component and a fluid component, and at least about 25% by volume of finely divided metal particles suspended within the liquid phase. An electrically heated element contacts a pavement surface, with the solidified pavement sealer layer covering a selected area of the pavement surface including the electrically heated element. The solidified pavement sealant layer includes at least about 25% by volume of finely divided metal particles. The electrically heated element transfers heat to the pavement sealant layer and metal particles therein to maintain the selected area of pavement surface free of ice and snow.

10 Claims, 2 Drawing Sheets

HEATED PAVEMENT SEALANT SYSTEM

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to sealants and, more particularly, to pavement sealants and, most particularly, to a pavement sealant that can be heated to remove ice and/or snow from the sealed pavement surface.

2. Background Information

The road system of many countries extends over millions of miles. In order to provide a durable surface that withstands the elements of weather, the majority of roads and streets are paved with concrete or asphalt, although bricks or stones are used in a few instances. In temperate climates, such paved roadways receive rain, or snow and ice during colder portions of the year. If the pavement develops cracks, liquid water can penetrate the cracks and cause deterioration of the integrity of the pavement. Rather than completely replace the pavement when cracking occurs, a sealant is commonly applied to the surface of the pavement to seal the cracks from the water. The commercially available sealants are fluid materials that are applied to the cracks or applied to the entire paved surface for protection. The sealant fluid is commonly an aqueous emulsion of various petroleum products, such as asphalt (petroleum refining residues) or coal tar (residue from destructive distillation of coal). Sealants are specialty coatings that are used for the protection and preservation of paved surfaces. The name itself defines the role; a coating that acts as a shield to protect components in the pavement, thus "locking-in" or "sealing-in" the redeeming properties of pavement. Water-based sealants are semi-fluid compositions, which are essentially fine dispersions of a binder component (coal tar or asphalt), in a clay/filler-water slurry. Such compositions are stabilized by specialty chemicals and additives. The fluid sealant is applied to the pavement and the aqueous fraction is allowed to evaporate to form a protective coating on the surface of the pavement.

Some sealant products contain an organic carrier fluid, such as oils derived from oil seeds, including linseed oil, soy bean oil, rape seed oil, etc. These organic liquid carrier fluids react chemically with oxygen in the air, and thus are incorporated into the sealant as it dries.

In addition, snow and/or ice can accumulate on paved roads, which results in a hazard to vehicles traveling over the pavement. In order to remove the snow/ice from the roadways, municipalities routinely apply salt or salt/sand mixtures to the roadways. The salt melts the snow/ice to clear the pavement, but the resulting salty water is of environmental concern.

Thus, there is an unmet need for a system that can maintain a paved roadway free of ice and snow, with minimal environmental effects, as well as seal the paved roadway to maintain the integrity of the pavement surface. Applicant has devised such a system for maintaining a paved roadway free of ice and snow with little effect on the surrounding environment.

SUMMARY OF THE INVENTION

The invention is directed to a fluid pavement sealer composition that comprises a liquid phase including a sealant component and a fluid component, and at least about 25% by volume of finely divided metal particles suspended within the liquid phase. In one embodiment of the invention, the fluid component comprises water and the sealant component comprises coal tar or asphalt mixed with emulsifier substances. In another embodiment of the invention, the fluid component comprises an oil of thick consistency, such as a heavy alkyd resin oil and/or a heavy linseed oil. The sealant component comprises coal tar or asphalt dispersed in the heavy oil component.

In a further embodiment of the invention, a heated pavement sealant system includes an electrically heated element contacting a pavement surface, with a pavement sealant layer covering a selected area of the pavement surface including the electrically heated element. The pavement sealant layer includes at least about 25% by volume of finely divided metal particles. The electrically heated element transfers heat to the pavement sealant layer and metal particles therein to maintain the selected area of pavement surface free of ice and snow.

DESCRIPTION OF THE EMBODIMENTS

Nomenclature

10 Heated Pavement Sealant System
20 Electrically Heated Element
30 Finely Divided Metal Particles
40 Continuous Sealant Layer
50 Regulator Device
60 Standard Electrical Plug
P Pavement Surface
S Selected Area Sealed Construction The invention is a fluid pavement sealer composition that comprises a liquid phase including a sealant component and a fluid component, and at least about 25% by volume of finely divided metal particles suspended within the liquid phase. In one embodiment of the invention, the fluid component comprises water and the sealant component comprises coal tar or asphalt mixed with emulsifier substances. In another embodiment of the invention, the fluid component comprises an oil of thick consistency, such as a heavy alkyd resin oil and/or a heavy linseed oil. The sealant component comprises coal tar or asphalt dispersed in the heavy oil component. In a further embodiment of the invention, a heated pavement sealant system includes an electrically heated element contacting a pavement surface, with a pavement sealant layer covering a selected area of the pavement surface including the electrically heated element. The pavement sealant layer includes at least about 25% by volume of finely divided metal particles. The electrically heated element transfers heat to the pavement sealant layer and metal particles therein to maintain the selected area of pavement surface free of ice and snow.

Figure 1:
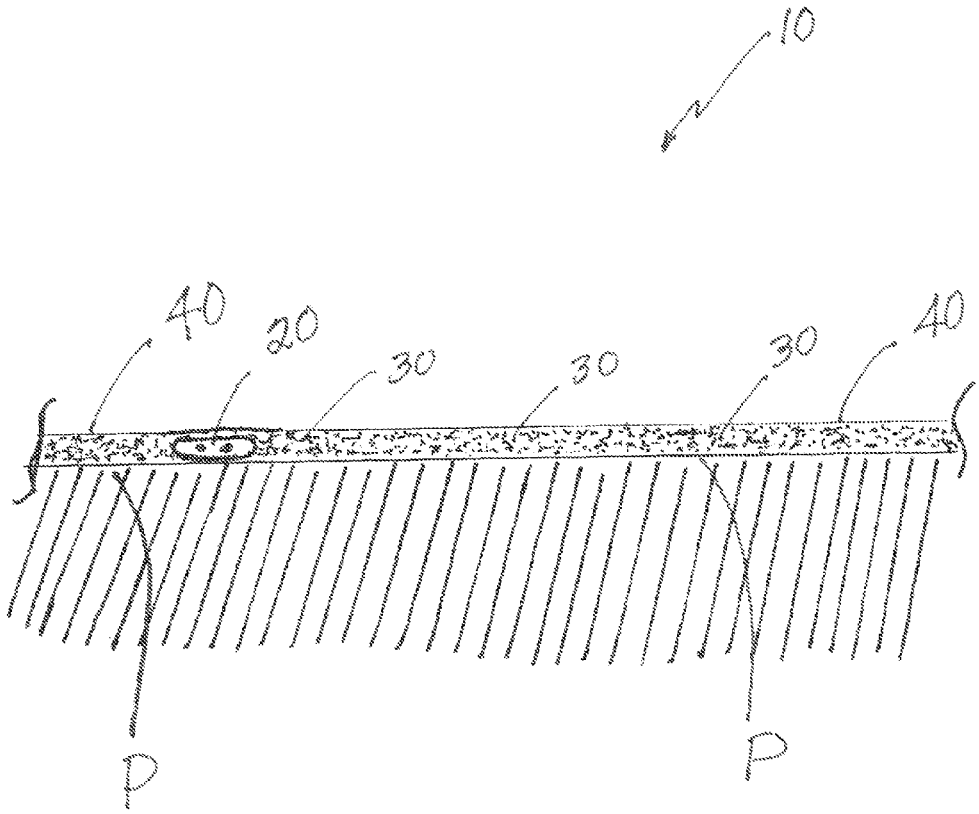
FIG. 1 is a cross sectional view of a portion of the heated pavement sealant system of the present invention.

Referring now to FIG. 1, a cross sectional view of a portion of the heated pavement sealant system 10 is shown. A n electrically heated element 20 is placed in contact with the pavement surface P to be covered with the fluid pavement composition of the present invention. The electrically heated element 20 is of sufficient size to extend along at least one edge of the pavement surface P to be covered by the fluid pavement sealer composition. The fluid pavement sealer composition can be a water-based composition or an oil-based (organic) composition and contains at least about 25% by volume of finely divided metal particles 30 suspended within the fluid pavement sealer composition. Preferably, the metal particles 30 are selected from aluminum, iron, steel alloy or mixtures thereof. These metal materials are the most readily available and least expensive for this purpose, although other metals can be included in the fluid pavement sealer composition, but at a higher cost. Most preferably, the finely divided metal particles 30 have a mesh size no larger than about 20 standard mesh, which corresponds to a particle diameter no larger than 0.033 inches. The small particle size of the finely divided metal enables uniform distribution of the metal particles 30 throughout the fluid pavement sealer composition.

The fluid pavement sealer composition with finely divided metal particles 30 is applied evenly to the surface of the pavement P and to the electrically heated element 20 secured there upon. As the pavement sealant layer dries or cures, it forms a continuous sealant layer 40 covering a selected area S of the pavement surface including the electrically heated element 20. The continuous pavement sealant layer 40 including at least about 25% by volume of finely divided metal particles 30 distributed uniformly throughout.

The electrically heated element 20 includes a standard male plug 60 which can be inserted into a standard electrical receptacle, thereby providing electrical power to the heated element 20. Preferably, the electrically heated element 20 includes a regulator device 50, which functions to limit the flow of electrical power to the electrically heated element 20. In operation, with electrical power supplied to the electrically heated element 20, the element 20 transfers heat to the pavement sealant layer 40 and the finely divided metal particles 30 therein, thereby heating the entire selected area S of the pavement surface P covered by the pavement sealant layer 40 to maintain that surface free of ice and snow. The high concentration of finely divided metal particles 30 in the cured pavement sealant layer 40 provides enhanced conduction of heat energy from the electrically heated element 20 throughout cured pavement sealant layer 40.

Figure 2:
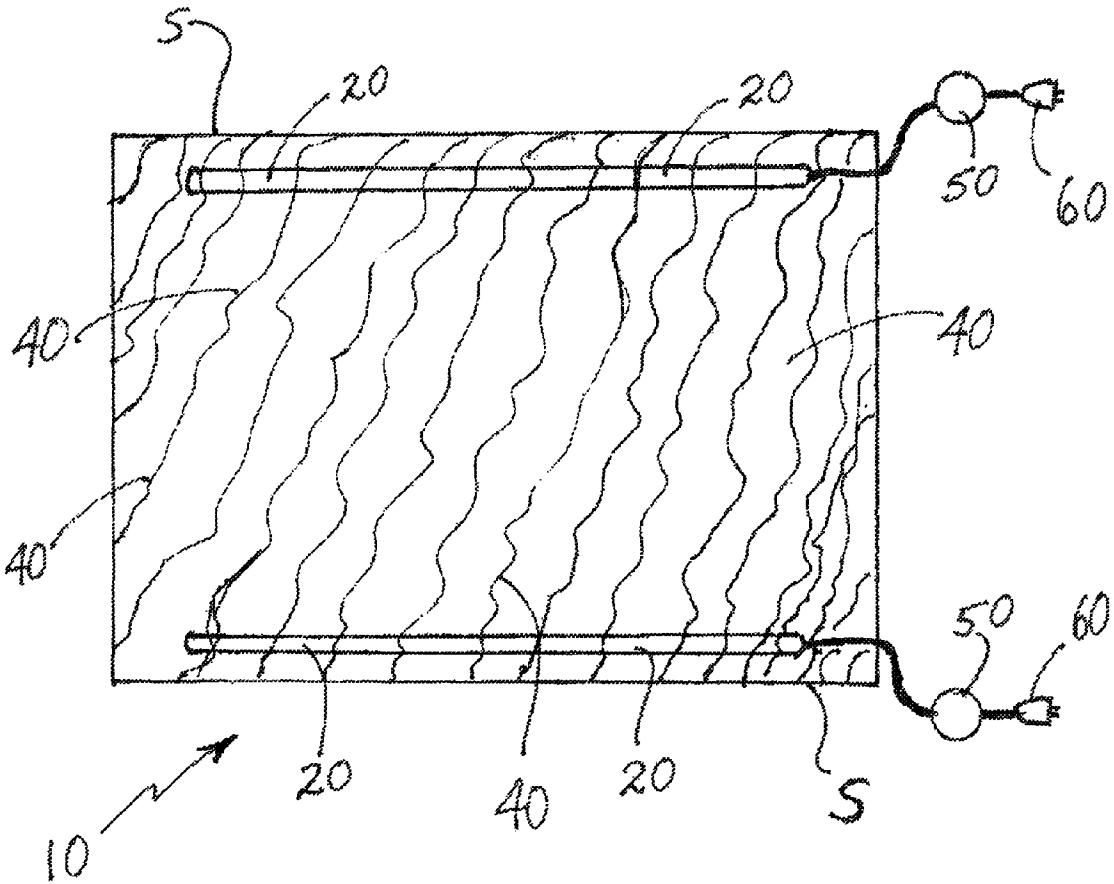
FIG. 2 is a top view of one embodiment of the heated pavement sealant system of the present invention.

For pavement surfaces covering larger areas, it is preferable that a plurality of electrically heated elements 20 are secured to the pavement surface P and covered by the sealant layer 40, with the heated elements 20 positioned at regular intervals on the pavement surface P, as illustrated in FIG. 2. In this embodiment of the invention, the electrically heated elements 20 are positioned along the edge of, for example, a large driveway, a roadway, a parking lot, or even a runway of an airport.

While the invention has been particularly shown and described with reference to preferred embodiments thereof, it will be understood by those skilled in the art that various changes in form and details may be made therein without departing from the spirit and scope of the invention.

I claim:

1. A heated pavement sealant system comprising:

an electrically heated element positioned upon and contacting a pavement surface;

a pavement sealant layer covering a selected area of the pavement surface including the electrically heated element;

the pavement sealant layer including at least about 25% by volume of finely divided metal particles;

whereby the electrically heated element transfers heat to the pavement sealant layer and metal particles therein to maintain the selected area of pavement surface free of ice and snow.

2. The fluid pavement sealer composition of claim 1, wherein the fluid component is water.

3. The fluid pavement sealer composition of claim 1, wherein the fluid component is an organic liquid.

4. The fluid pavement sealer composition of claim 3, wherein the organic liquid comprises a heavy oil selected from the group consisting of alkyd resin oil, linseed oil, soy bean oil, rape seed oil and mixtures thereof.

5. The heated pavement sealant system of claim 1, wherein the finely divided metal particles have a size no larger than about 20 standard mesh (0.033 inch diameter).

6. The heated pavement sealant system of claim 1, wherein the finely divided metal particles are selected from the group consisting of aluminum, iron, steel alloy and mixtures thereof.

7. The heated pavement sealant system of claim 1, wherein the finely divided metal particles have a size no larger than about 20 standard mesh (0.033 inch diameter).

8. A heated pavement sealant system comprising:

an electrically heated element positioned upon and contacting a pavement surface;

a pavement sealant layer covering a selected area of the pavement surface including the electrically heated element;

the pavement sealant layer including at least about 25% by volume of finely divided metal particles, the particles selected from the group consisting of aluminum, iron, steel alloy and mixtures thereof;

whereby the electrically heated element transfers heat to the pavement sealant layer and metal particles therein to maintain the selected area of pavement surface free, of ice and snow.

9. The fluid pavement sealer composition of claim 8, wherein the fluid component is water.

10. The fluid pavement sealer composition of claim 8, wherein the fluid component is an organic liquid.

* * * * *